US005156331A

United States Patent [19]

Pirre

[11] Patent Number: 5,156,331

[45] Date of Patent: Oct. 20, 1992

[54] RE-CLOSABLE BOX CONSTRUCTION FOR DISPENSING SHEET MATERIALS

[75] Inventor: Donald A. Pirre, Wind Gap, Pa.

[73] Assignee: Hoechst Celanese Corporation, Somerville, N.J.

[21] Appl. No.: 821,110

[22] Filed: Jan. 15, 1992

[51] Int. Cl.[5] ..... B65D 5/54

[52] U.S. Cl. ..... 229/223; 206/455; 229/40; 493/89; 493/140

[58] Field of Search ..... 229/23 R, 40, 223; 206/215, 455; 493/84, 89, 116, 136, 140, 906

[56] References Cited

U.S. PATENT DOCUMENTS

| | | | |
|---|---|---|---|
| 2,196,482 | 4/1940 | Taylor | 206/215 |
| 2,955,000 | 10/1960 | Vohden | 206/215 |
| 3,173,537 | 3/1965 | Doyle | 206/455 |
| 3,295,741 | 1/1967 | Meyers | 229/40 |
| 3,591,071 | 7/1971 | Rosenburg, Jr. | 229/223 |
| 3,885,729 | 5/1975 | Rous et al. | 229/40 |
| 3,989,141 | 11/1976 | Rous | 229/40 |
| 4,174,041 | 11/1979 | Turner | 229/40 |
| 4,560,102 | 12/1985 | Dlugopolski | 229/40 |
| 5,029,709 | 7/1991 | Faulstick | 206/455 |

*Primary Examiner*—Gary E. Elkins
*Attorney, Agent, or Firm*—Richard S. Roberts

[57] ABSTRACT

A reclosable box construction suitable for storing, transporting, and dispensing sheet materials, as well as an article and method for making the box construction. The box construction has an outer shell and an insert member. The outer shell member has a generally rectangular central panel of flexible sheet material, a pair of side panels folder into a plane above the central panel, a first and second wing panels positioned over a portion of each of said side panels at opposite longitudinal ends of the central panel, the second wing panel having a removable pull tab element. The insert member comprises top and bottom rectangular panels joined at a fold line and having a tearable perforation line along its entire width. The insert member is positioned within the outer shell such that the side panels are between the top and bottom rectangular panels. The bottom insert panel is positioned between said central panel and the side panels and the top insert panel is between the side panels and the two wing panels. The wing panels are closed with pressure sensitive adhesive tape.

23 Claims, 5 Drawing Sheets

RE-CLOSABLE BOX CONSTRUCTION FOR DISPENSING SHEET MATERIALS

BACKGROUND OF THE INVENTION

The present invention relates to a reclosable box construction suitable for storing, transporting, and dispensing sheet materials such as papers, photographic films, lithographic printing plates, color proofing films and the like.

It is well known in the art to produce shipping and storage boxes in a wide variety of sizes and shapes. The most common is a hollow, six sided cubic or rectangular structure having corrugated cardboard side walls as well as top and bottom closures. It is also well known in the art to provide such storage and shipping boxes for sheet materials such as papers, photographic films, color proofing films and the like. However, this invention provides an improved box configuration which can not only serve as a shipping and storage container for such sheet materials, but may also thereafter be conveniently employed by the user as a dispenser for sheet materials and can be re-closed for easy, repeated dispensing and re-closing operations.

SUMMARY OF THE INVENTION

Figure 1:
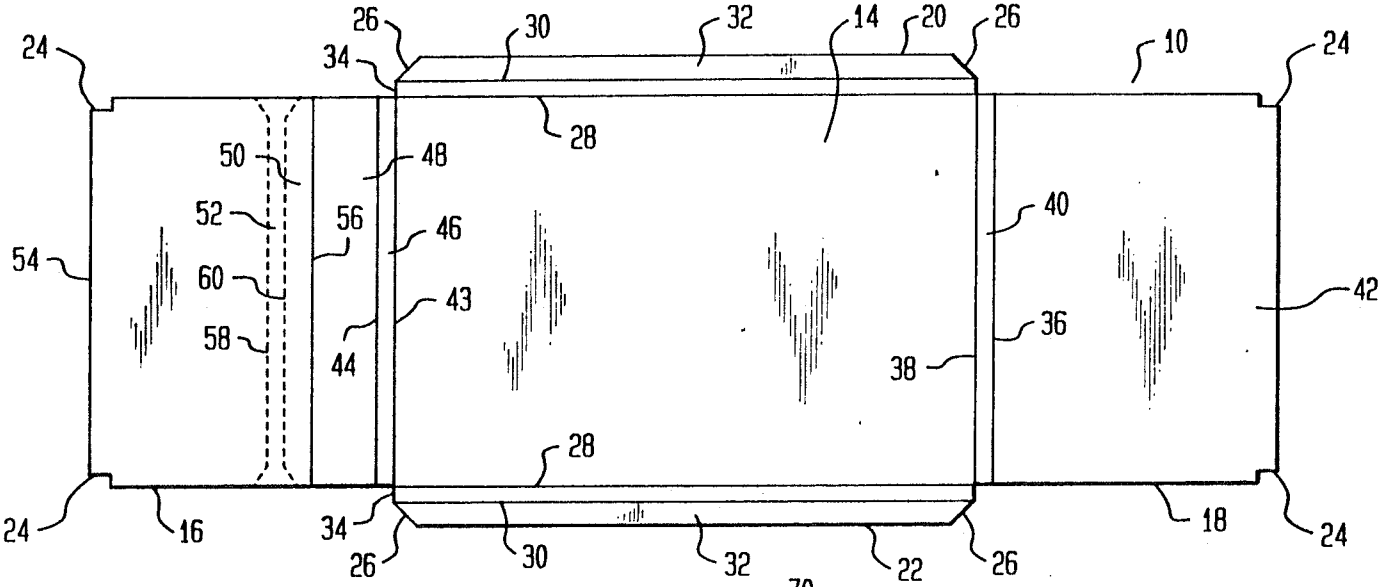
FIG. 1 is a plan view of a shell member which forms the outermost structure of the inventive box structure.

The invention provides an article for forming a box construction which comprises:

a) an outer shell member which comprises:

i) a generally rectangular central panel of flexible sheet material having a length and a width respectively defining two longitudinal and two transverse ends; and ii) a pair of side panels of flexible sheet material, each hingedly joined to one of said transverse ends at first fold lines which extend a distance the entire length between said side panels and the central panel, each of said side panels having a second fold line parallel to said first fold line which extends the entire length of said side panel; and iii) a first wing panel of flexible sheet material hingedly joined to one of the longitudinal ends of the central panel at a third fold line which extends a distance the entire width at the interface of said first wing panel and the central panel, said first wing panel having a fourth fold line parallel to and spaced from said third fold line which extends the entire width of said first wing panel; and iv) a second wing panel of flexible sheet material hingedly joined to the opposite longitudinal end of the central panel at a fifth fold line which extends a distance the entire width at the interface of said second wing panel and the central panel; said second wing panel having sequentially a sixth fold line parallel to and spaced from said fifth fold line which extends the entire width of said second wing panel and a seventh fold line parallel to and spaced from said sixth fold line which extends the entire width of said second wing panel and then a pair of spaced, tearable perforation lines which extend the entire width of said second wing panel, which pair of spaced perforation lines form a removable pull tab element; and b) an insert member which comprises two generally rectangular panels of flexible sheet material defining a top insert panel and a bottom insert panel each having a length and a width, said top and bottom insert panels being joined at a central fold line extending their entire width; said top insert panel having a tearable perforation line spaced from said central fold line and extending the entire width of said top insert panel.

The invention also provides a box construction which comprises:

a) an outer shell member which comprises:

i) a generally rectangular central panel of flexible sheet material having a length and a width respectively defining two longitudinal and two transverse ends; and ii) a pair of side panels of flexible sheet material, each hingedly joined to one of said transverse ends at first fold lines which extend a distance the entire length between said side panels and the central panel, each of said side panels being folded along said first fold line into a plane perpendicular to the plane of said central panel, and each of said side panels having a second fold line parallel to said first fold line which extend the entire length of said side panels, each of said side panels being folded along said second fold line into a plane parallel to and above the plane of said central panel; and iii) a first wing panel of flexible sheet material hingedly joined to one of the longitudinal ends of the central panel at a third fold line which extends a distance the entire width and at the interface of said first wing panel and the central panel, said first wing panel being folded along said third fold line into a plane perpendicular to the plane of said central panel, said first wing panel having a fourth fold line parallel to and spaced from said third fold line which extends the entire width of said first wing panel, said first wing panel being folded along said fourth fold line into a plane parallel to the plane of said central panel and being positioned over a portion of each of said side panels; and iv) a second wing panel of flexible sheet material hingedly joined to the opposite longitudinal end of the central panel at a fifth fold line which extends a distance the entire width and at the interface of said second wing panel and the central panel; said second wing panel having sequentially a sixth fold line parallel to and spaced from said fifth fold line which extends the entire width of said second wing panel and a seventh fold line parallel to and spaced from said sixth fold line which extends the entire width of said second wing panel and then a pair of spaced, tearable perforation lines which extend the entire width of said second wing panel, which pair of spaced perforation lines form a removable pull tab element; said second wing panel being folded along said fifth fold line into a plane perpendicular to the plane of said central panel, said second wing panel being folded along said sixth fold line into a plane parallel to the plane of said central panel and being positioned over a portion of each of said side panels; and b) an insert member which comprises two generally rectangular panels of flexible sheet material defining a top insert panel and a bottom insert panel each having a length and a width, said top and bottom insert panels being joined at a central fold line extending their entire width; said top insert panel having a tearable perforation line spaced from said central fold line and extending the entire width of said top insert panel; said insert member being positioned within said outer shell member such that the bottom insert panel is disposed between said central panel and said side panels and said top insert panel is disposed between said side panels and said first and second wing panels and said central fold line of the insert member being in juxtaposition with the second wing panel at said opposite longitudinal end of the central panel.

The invention further provides a method of forming a box construction which comprises:

a) providing an outer shell member which comprises:

i) a generally rectangular central panel of flexible sheet material having a length and a width respectively defining two longitudinal and two transverse ends; and ii) a pair of side panels of flexible sheet material, each hingedly joined to one of said transverse ends at first fold lines which extend a distance the entire length between said side panels and the central panel, each of said side panels having a second fold line parallel to said first fold line which extends the entire length of said side panel; and iii) a first wing panel of flexible sheet material hingedly joined to one of the longitudinal ends of the central panel at a third fold line which extends a distance the entire width at the interface of said first wing panel and the central panel, said first wing panel having a fourth fold line parallel to and spaced from said third fold line which extends the entire width of said first wing panel; and iv) a second wing panel of flexible sheet material hingedly joined to the opposite longitudinal end of the central panel at a fifth fold line which extends a distance the entire width at the interface of said second wing panel and the central panel; said second wing panel having sequentially a sixth fold line parallel to and spaced from said fifth fold line which extends the entire width of said second wing panel and a seventh fold line parallel to and spaced from said sixth fold line which extends the entire width of said second wing panel and then a pair of spaced, tearable perforation lines which extend the entire width of said second wing panel, which pair of spaced perforation lines form a removable pull tab element; and b) providing an insert member which comprises two generally rectangular panels of flexible sheet material defining a top insert panel and a bottom insert panel each having a length and a width, said top and bottom insert panels being joined at a central fold line extending their entire width; said top insert panel having a tearable perforation line spaced from said central fold line and extending the entire width of said top insert panel; and c) folding each of said side panels along said first fold line into a plane perpendicular to the plane of said central panel, and then folding each of said side panels at the second fold line into a plane parallel to and above the plane of said central panel; and d) folding said first wing panel along said third fold line into a plane perpendicular to the plane of said central panel, and then folding said first wing panel along said fourth fold line into a plane parallel to the plane of said central panel and being positioned over a portion of each of said side panels; and e) folding the insert member at its central fold line and positioning the insert member within said outer shell member such that the bottom insert panel is disposed between said central panel and said side panels and said top insert panel is disposed between said side panels and said first wing panel with said central fold line of the insert member being positioned at said opposite longitudinal end of the central panel; and f) folding the second wing panel along said fifth fold line into a plane perpendicular to the plane of said central panel and then folding said second wing panel along said sixth fold line into a plane parallel to the plane of said central panel and being positioned over said insert member; and g) adhering a band of pressure sensitive adhesive tape around both said central panel and an end of each of said first and second wing panels; and h) adhering a second band of pressure sensitive adhesive tape extending around said central panel and around said second wing panel between said first band of pressure sensitive adhesive tape and said pull tab element.

DETAILED DESCRIPTION OF THE PREFERRED EMBODIMENT

Figure 2:
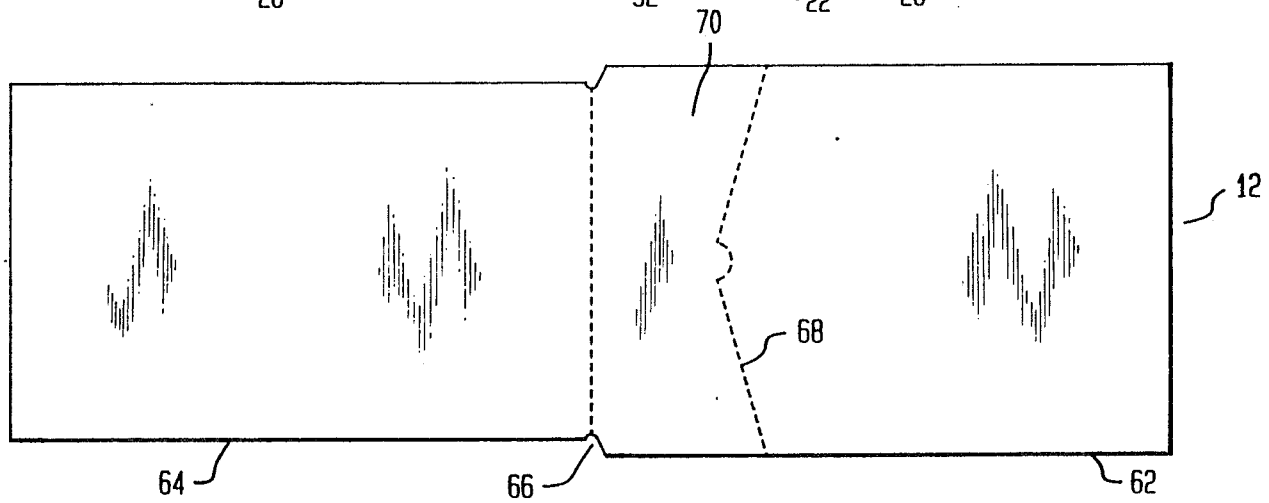
FIG. 2 is a plan view of an insert member which is set into the shell member when the box construction is erected.

The box construction of the present invention comprises an outer shell member 10 and an insert member 12 as shown in FIGS. 1 and 2. Shell member 10 comprises a rectangular central panel 14 having generally rectangular attached wing panels 16 and 18 on opposite sides of central panel 14. Wing panels 16 and 18 are of approximately the same size. Attached on the two remaining side of central panel 14 are side panels 20 and 22. Side panels 20 and 22 are of approximately the same size. In one preferred embodiment, wing panels 16 and 18 are notched at their corners as shown at points 24. In a preferred embodiment, side panels 20 and 22 are notched at corners 26. Side panels 20 and 22 are provided with two fold lines 28 and 30 to divide each side panel into members 32 and 34. When panels 20 and 22 are folded up along fold lines 28, members 34 provide a side wall structural elements which are in planes perpendicular to the plane of central panel 14. When members 20 and 22 are then folded inwardly with respect to central panel 14 at fold lines 30, members 32 are positioned in a plane perpendicular to that of members 34 and in a plane parallel to the plane of central panel 14. Members 32 and 3 provide support for the box construction during stacking. In use, wing panel 18 is folded inwardly toward central panel 14 along fold lines 36 and 38 thus forming end wall section 40 which is in a plane perpendicular to that of central panel 14, and top portion 42 which is in a plane parallel to the plane of central panel 14. In use, top portion 42 is positioned over members 32, that is, each of central panel 14, side member 32 and top portion 42 are in overlapping parallel planes spaced from one another in the order of first central panel 14, then both members 32 and then top portion 42. In use, wing panel 16 is likewise folded inwardly toward central panel 14 along fold lines 43 and 44 thus forming opposite end wall section 46 which is in a plane perpendicular to the plane of central panel 14. The balance of side wing 16 comprises parts designated as 48, 50, 52 and 54 which are formed in a plane parallel to the plane of central panel 14 and extend in an inward direction toward top portion 42. It may meet the edge of top portion 42, but preferably does not overlap top portion 42. In use, parts 48, 50, 52 and 54 are positioned over members 32, that is, each of central panel 14, the panel comprising parts 48, 50 52 and 54, as well as members 32 are in overlapping parallel planes spaced from one another in the order of first central panel 14, then both members 32 and then the combined panel 48, 50, 52, and 54. The associated panels 42, 48, 50, 52 and 54 form the top cover of the box construction. Wing panel 16 is provided with a fold line at 56 as well as perforation lines 58 and 60 o either side of part 52 which is a removable pull tab.

The box construction of the invention further comprises an insert member 12 as shown in FIG. 2. Insert member 12 comprises two generally rectangular portions which are an insert top panel 62 and an insert bottom panel 64 joined at a fold line 66 which is prefereably also perforated. In the preferred embodiment, panel 62 is slightly larger in length and/or width than central panel 14, and panel 64 is approximately the same size as central panel 14. Insert top panel 62 is provided with a perforation line 68 across its width to define panel 70 between fold 66 line and perforation line 68.

Figure 3:
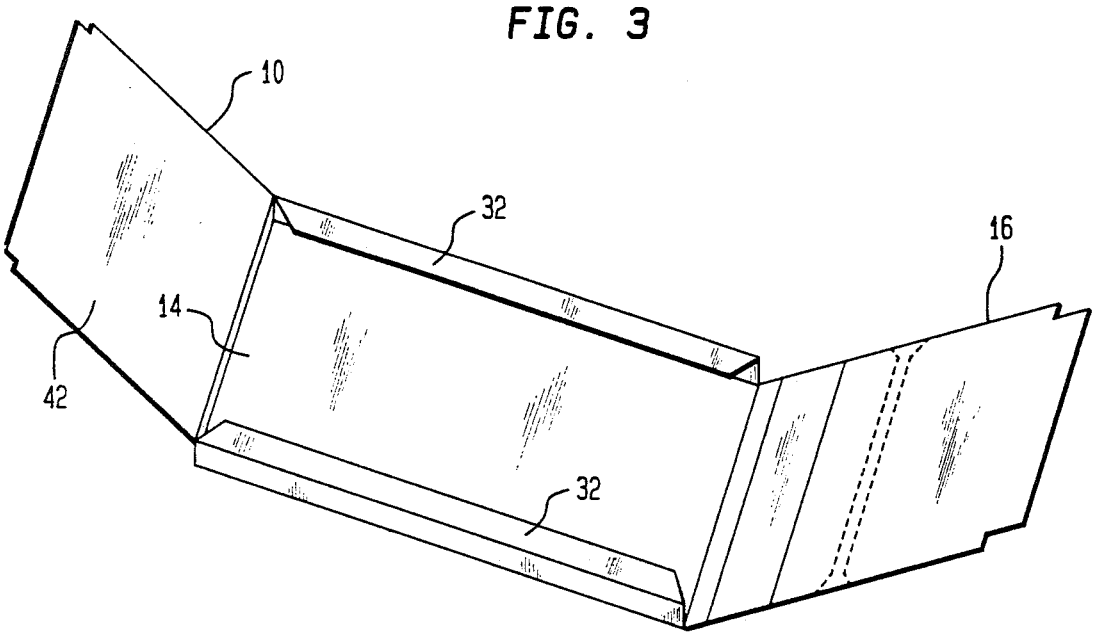
FIG. 3 is a perspective view of a partly erected shell member with some of its panels folded.
Figure 4:
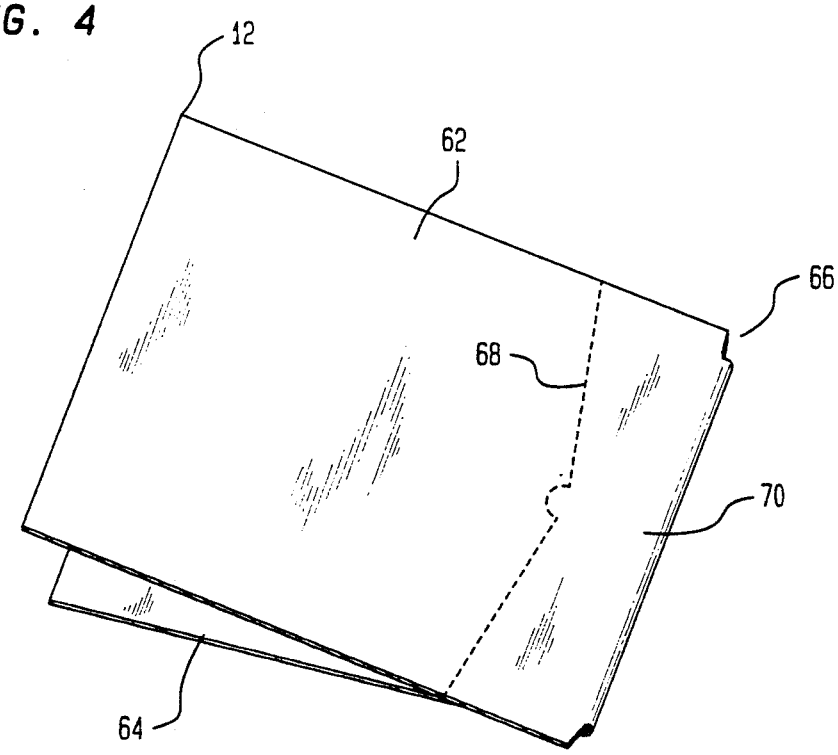
FIG. 4 is a perspective view of an insert member which is in a folded position ready for setting into the shell member.
Figure 5:
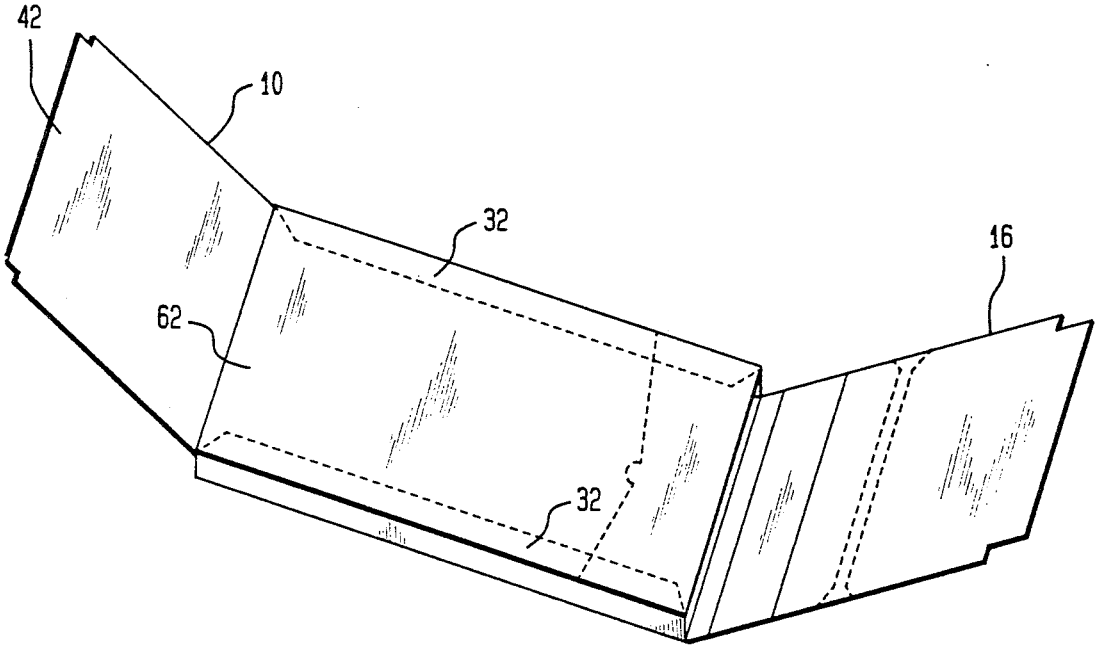
FIG. 5 is a perspective view of a partly erected box construction with an insert member in a folded position set into the shell member.
Figure 6:
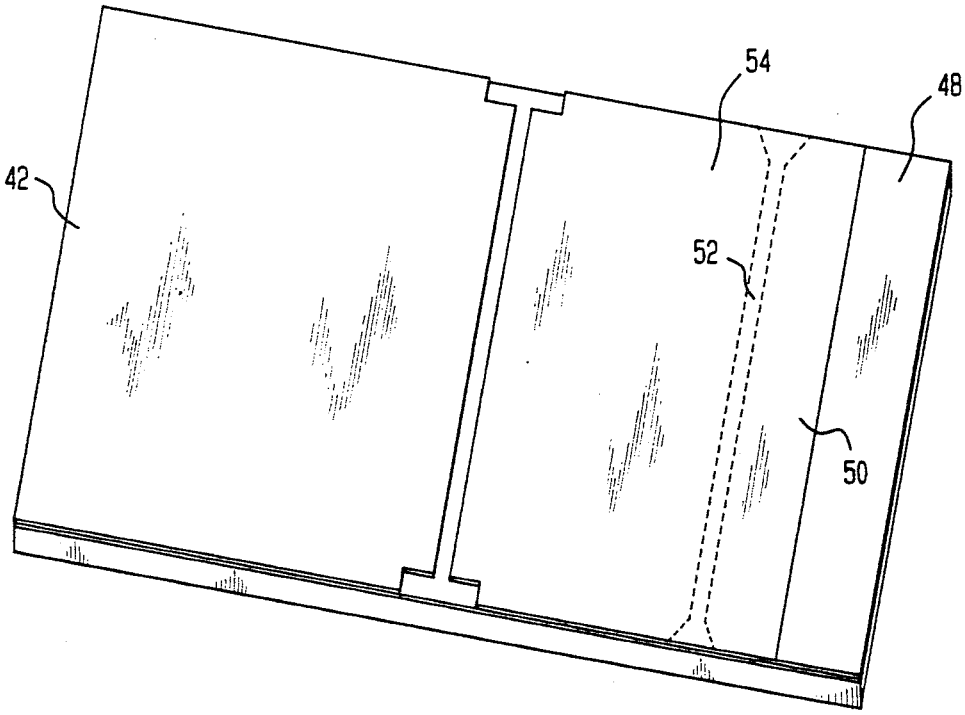
FIG. 6 is a perspective view of a partly erected box construction with an insert member set into the shell member and the wing panels of the shell member in a closed position prior to being taped closed.
Figure 7:
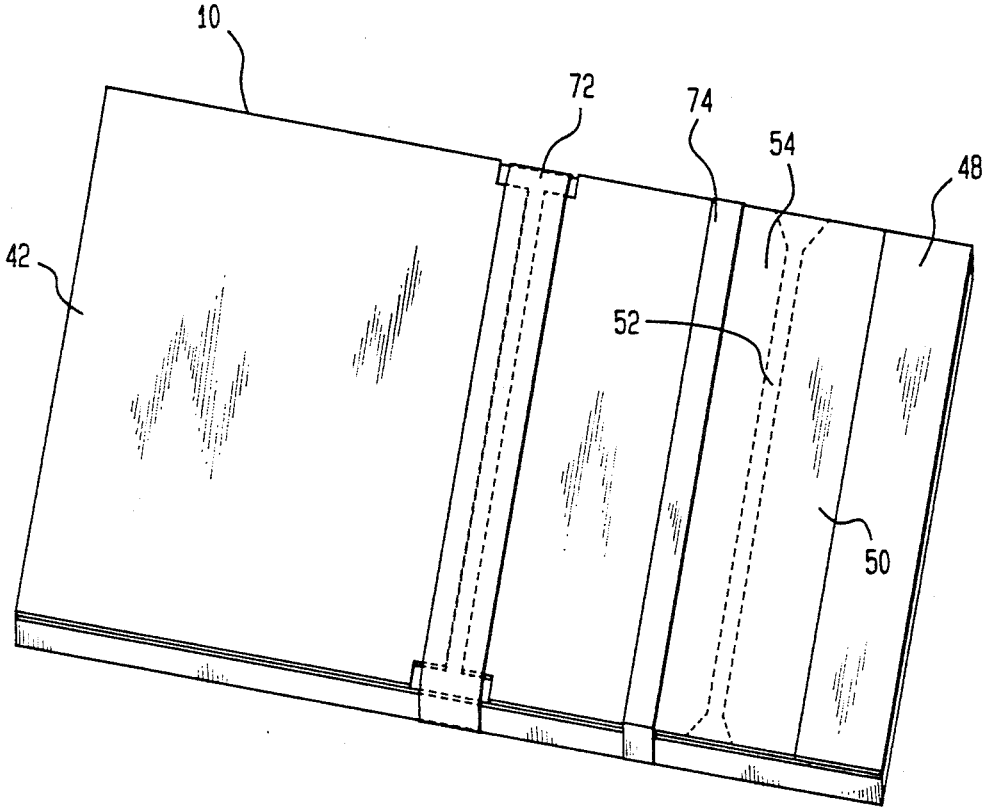
FIG. 7 is a perspective view of an erected box construction with an insert member set into the shell member and the wing panels of the shell member in a closed position after being taped closed.

As best seen in FIG. 3, as the first step in erecting the box, side panels 20 and 22 are folded along fold lines 28 and 30 to form side wall structural elements 34 which are in planes perpendicular to the plane of central panel 14. Members 32 are then folded inwardly at fold lines 30 and positioned in a plane perpendicular to that of members 34 and in a plane parallel to the plane of central panel 14. As shown in FIG. 4, insert member 12 is then folded along fold line 66. Member 12 is then inserted into shell member 10 such that insert bottom panel 64 slides on top of central panel 14 and under side members 32, while insert top panel 62 is positioned on top of side members 32 as shown in FIG. 5. Sheet materials which are to be placed in the box construction are positioned under the insert bottom panel 64. The two wing panels are then closed on top of the insert panel as seen in FIG. 6. The box construction is sealed across its width with adhesive tape 72 and 74. In the preferred embodiment, tape 72 spans each of the ends of parts 42 and 54 as shown. Tape 74 serves to retain panel 54 in position. FIG. 7 shows the construction of the invention as it appears in use for shipping and storing sheet materials.

Figure 8:
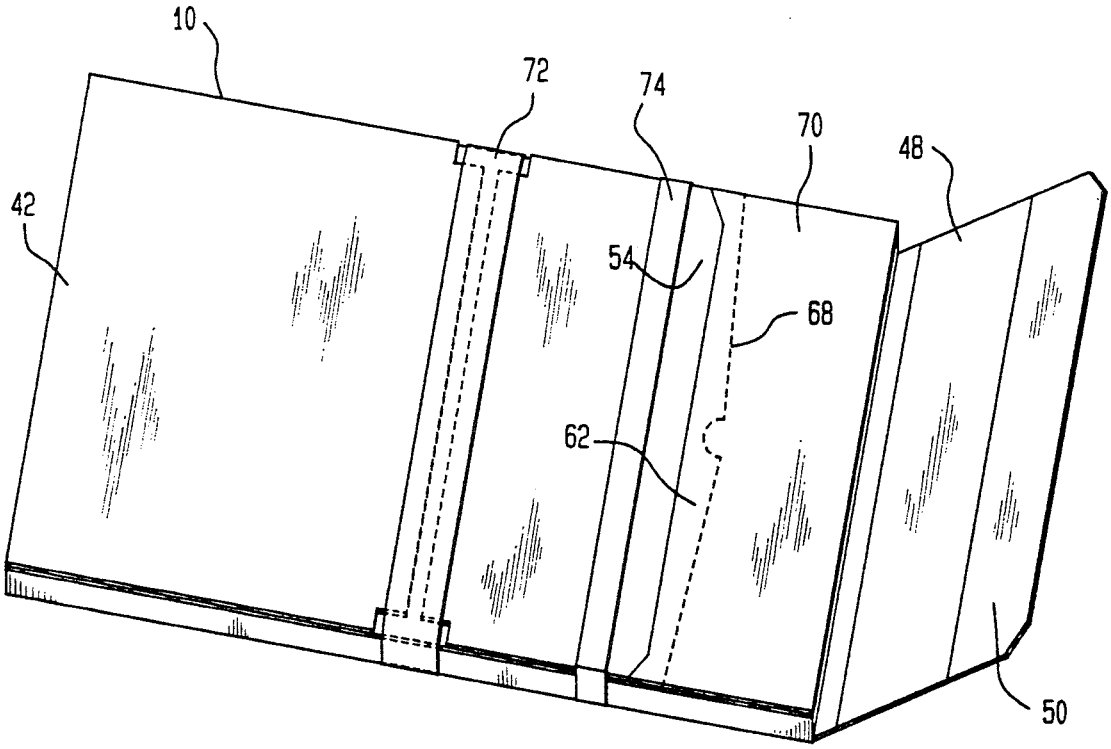
FIG. 8 is a perspective view of the box construction after removal of its pull tab and unfolding of the end flap of the box.
Figure 9:
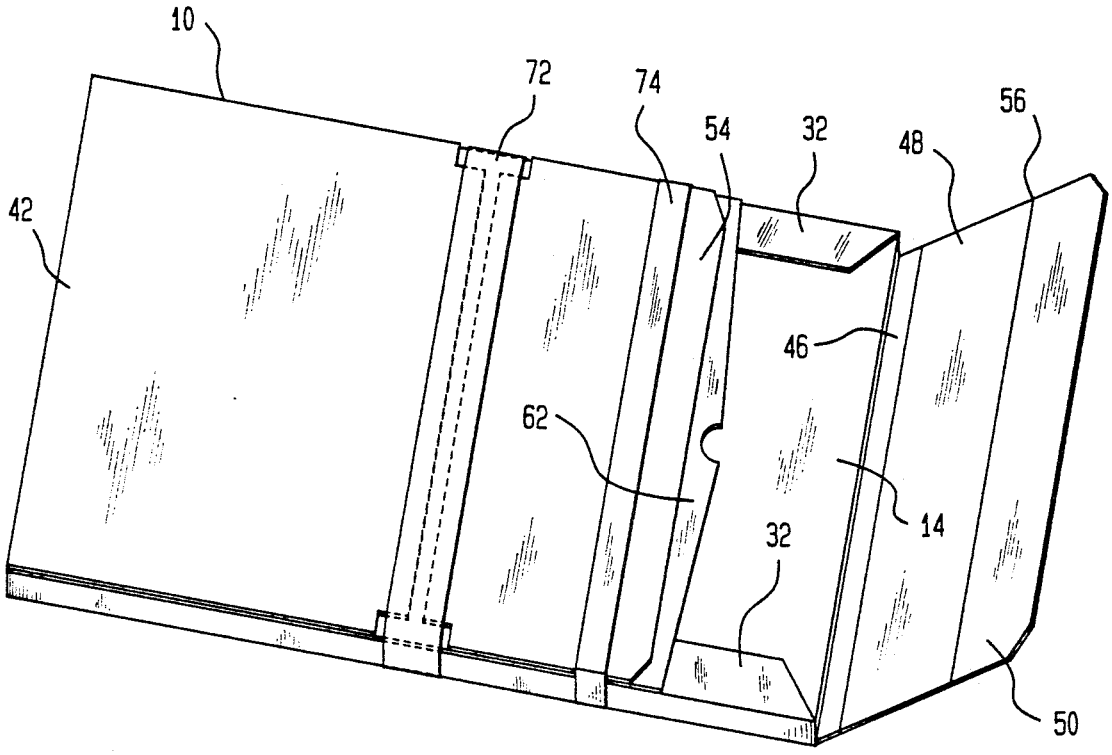
FIG. 9 is a perspective view of the box construction after unfolding the end flap of the box and removal of the removable portion of the insert member whereby the box is in position to dispense its contents.
Figure 10:
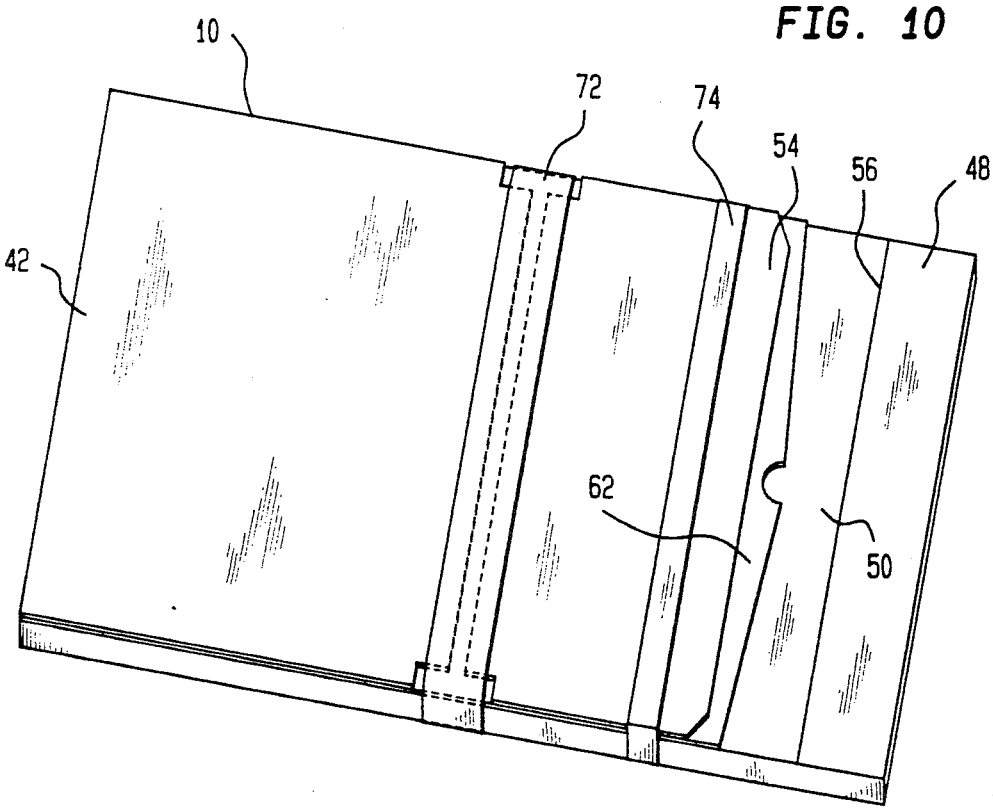
FIG. 10 is a perspective view of the box construction after refolding the end flap of the box whereby the box is in a reclosed configuration.

One important use for the box construction of the invention is for dispensing sheet materials. When the user desires to remove one or more sheets from the box, the first step is to remove pull tab 52 by tearing along perforation line 58 and 60. The provision of a pull tab eliminates the need for knives or other tools to open the box which might cut the sheet contents. Pulling of the tab forms an end flap to the box which comprises panels 48 and 50 as shown in FIG. 8. Folding back this end flap thus reveals part of the insert top panel. Next the user tears the insert top panel along perforation line 68 and pulls out both panel 70 and the entirety of connected insert bottom panel 64 while leaving the balance of insert top panel 62 inside shell 10. This is best seen in FIG. 9. The sheet material is disposed under side panels 32 on top of center panel 14. The removed portion of the insert bottom panel serves as a spacer sheet which gives support to the side walls 34 during shipping and storage so that the walls to not collapse. After removal of the insert bottom panel, the inside of the box is thereby provided with air space. This air space prevents the box from putting too much tension on the sheet contents during sheet removal and allows them to come out easily. FIG. 10 shows the box construction of the invention in a re-closed position after the dispensing of therein contained sheet materials. As one can see, panel 48 folds up, panel 50 folds down lightly along fold line 56, and then the leading edge of panel 50 is inserted under the edge of panel 62 but on top of side panels 32 to effect closure. For re-opening to remove additional sheet material, panel 50 is slightly bent along fold line 56 to slide it out from between panels 32 and 62, and then both panels 48 and 50 are folded out again as shown in FIG. 9.

In the preferred embodiment, each of shell member 10 and an insert member 12 are composed of flat sheet material such as paperboard, fiberboard, paperboard coated with plastic, or most preferably corrugated cardboard. The material selected and the thickness thereof may vary depending on the cost, weight, and strength characteristics desired. Such materials are well known in the art. Each is preferably manufactured from a flat rectangular sheet of corrugated cardboard and the cutout portions are knife or die cut by high speed machinery in the configurations shown in FIGS. 1 and 2 by means well known to the skilled artisan. Likewise, the perforation lines and fold lines may be scored by known methods. The depth of the score lines is determined by the selection of desired material for the intended use. Each of shell member 10 and an insert member 12 are of unitary construction capable of being manufactured, shipped, handled and stored in a flat, collapsed configuration as shown in FIGS. 1 and 2 and yet may be readily folded and taped closed into the desired box construction either by machinery or an unskilled person in a very short time. In the preferred embodiment, tape bands 72 and 74 may be composed of ordinary pressure sensitive, shipping strength, adhesive tape or fiber thread containing tape as are readily available commercially. Of course, the outer surfaces of the box construction can be provided with any desired indicia such as advertising information, labels, product specifications and the like.

One advantage to the use of a shell member 10 and an insert member 12 is that the two act reciprocally to provide strength and rigidity to the box as a whole. It is known in the art that corrugated cardboard maybe constructed with the direction of corrugation lines either being longitudinal or transverse to the blank sheet from which the panels are made. In the preferred embodiment, each of shell member 10 and an insert member 12 are composed of corrugated cardboard having corrugation lines displaced 90 degrees from one another. That is one has longitudinally extending corrugation lines along its length and the other has transversely extending corrugation lines extending across its width. In the most preferred embodiment, shell member 10 has longitudinally extending corrugation lines along its length and insert member 12 has transversely extending corrugation lines extending across its width. This provides added box strength. Another advantage of the box construction is that it is self locking and does not require the use of rivets, staples or messy glues to maintain its structure. This is important since rivets and staples tend to leave indentations in sheet materials in the box and glues tend to seep onto sheet materials and render them useless.

What is claimed is:

1. Members for forming a box construction, said members comprising:

a) an outer shell member which comprises:

i) a generally rectangular central panel of flexible sheet material having a length and a width respectively defining two longitudinal and two transverse ends; and ii) a pair of side panels of flexible sheet material, each hingedly joined to one of said transverse ends at first fold lines which extend a distance the entire length between said side panels and the central panel, each of said side panels having a second fold line parallel to said first fold line which extends the entire length of said side panel; and iii) a first wing panel flexible sheet material hingedly joined to one of the longitudinal ends of the central panel at a third fold line which extends a distance the entire width at the interface of said first wing panel and the central panel, said first wing panel having a fourth fold line parallel to and spaced from said third fold line which extends the entire width of said first wing panel; and iv) a second wing panel of flexible sheet material hingedly joined to the opposite longitudinal end of the central panel at a fifth fold line which extends a distance the entire width at the interface of said second wing panel and the central panel; said second wing panel having sequentially a sixth fold line parallel to and spaced from said fifth fold line which extends the entire width of said second wing panel and a seventh fold line parallel to and spaced from said sixth fold line which extends the entire width of said second wing panel and then a pair of spaced, tearable perforation lines which extend the entire width of said second wing panel, which pair of spaced perforation lines form a removable pull tab element; and b) an insert member which comprises two generally rectangular panels of flexible sheet material defining a top insert panel and a bottom insert panel each having a length and a width, said top and bottom insert panels being joined at a central fold line extending their entire width; said top insert panel having a tearable perforation line spaced from said central fold line and extending the entire width of said top insert panel.

2. The members of claim 1 wherein each of the outer shell member and the insert member comprise a material selected from the group consisting of paperboard, fiberboard, paperboard coated with plastic, and corrugated cardboard.

3. The members of claim 1 wherein each of the outer shell member and an insert member are composed of corrugated cardboard having corrugation lines displaced 90 degrees from one another.

4. The members of claim 3 wherein the outer shell member has longitudinally extending corrugation lines along its length and the insert member has transversely extending corrugation lines extending across its width.

5. The members of claim 1 wherein each of the wing panels and side panels are notched at their corners.

6. The members of claim 1 wherein the wing panels are of approximately the same size and the side panels are of approximately the same size.

7. The members of claim 1 wherein the insert top panel is slightly larger than the central panel, and the insert bottom panel and the central panel are of approximately the same size.

8. A box construction which comprises:

a) an outer shell member which comprises:

i) a generally rectangular central panel of flexible sheet material having a length and a width respectively defining two longitudinal and two transverse ends; and ii) a pair of side panels of flexible sheet material, each hingedly joined to one of said transverse ends at first fold lines which extend a distance the entire length between said side panels and the central panel, each of said side panels being folded along said first fold line into a plane perpendicular to the plane of said central panel, and each of said side panels having a second fold line parallel to said first fold line which extend the entire length of said side panels, each of said side panels being folded along said second fold line into a plane parallel to and above the plane of said central panel; and iii) a first wing panel of flexible sheet material hingedly joined to one of the longitudinal ends of the central panel at a third fold line which extends a distance the entire width and at the interface of said first wing panel and the central panel, said first wing panel being folded along said third fold line into a plane perpendicular to the plane of said central panel, said first wing panel having a fourth fold line parallel to and spaced from said third fold line which extends the entire width of said first wing panel, said first wing panel being folded along said fourth fold line into a plane parallel to the plane of said central panel and being positioned over a portion of each of said side panels; and iv) a second wing panel of flexible sheet material hingedly joined to the opposite longitudinal end of the central panel at a fifth fold line which extends a distance the entire width and at the interface of said second wing panel and the central panel; said second wing panel having sequentially a sixth fold line parallel to and spaced from said fifth fold line which extends the entire width of said second wing panel and a seventh fold line parallel to and spaced from said sixth fold line which extends the entire width of said second wing panel and then a pair of spaced, tearable perforation lines which extend the entire width of said second wing panel, which pair of spaced perforation lines form a removable pull tab element; said second wing panel being folded along said fifth fold line into a plane perpendicular to the plane of said central panel, said second wing panel being folded along said sixth fold line into a plane parallel to the plane of said central panel and being positioned over a portion of each of said side panels; and b) an insert member which comprises two generally rectangular panels of flexible sheet material defining a top insert panel and a bottom insert panel each having a length and a width, said top and bottom insert panels being joined at a central fold line extending their entire width; said top insert panel having a tearable perforation line spaced from said central fold line and extending the entire width of said top insert panel; said insert member being positioned within said outer shell member such that the bottom insert panel is disposed between said central panel and said side panels and said top insert panel is disposed between said side panels and said first and second wing panels and said central fold line of the insert member being in juxtaposition with the second wing panel at said opposite longitudinal end of the central panel.

9. The box construction of claim 8 further comprising a band of pressure sensitive adhesive tape extending around said central panel and an end of each of said first and second wing panels.

10. The box construction of claim 9 further comprising a second band of pressure sensitive adhesive tape extending around said central panel and around said second wing panel between said first band of pressure sensitive adhesive tape and said pull tab element.

11. The box construction of claim 8 wherein each of the outer shell member and the insert member comprise a material selected from the group consisting of paperboard, fiberboard, paperboard coated with plastic, and corrugated cardboard.

12. The box construction of claim 8 wherein each of the outer shell member and an insert member are composed of corrugated cardboard having corrugation lines displaced 90 degrees from one another.

13. The box construction of claim 12 wherein the outer shell member has longitudinally extending corrugation lines along its length and the insert member has transversely extending corrugation lines extending across its width.

14. The box construction of claim 8 wherein each of the wing panels and side panels are notched at their corners.

15. The box construction of claim 8 wherein the wing panels are of approximately the same size and the side panels are of approximately the same size.

16. The box construction of claim 8 wherein the insert top panel is slightly larger than the central panel, and the insert bottom panel and the central panel are of approximately the same size.

17. A method of forming a box construction which comprises:

a) providing an outer shell member which comprises:

i) a generally rectangular central panel of flexible sheet material having a length and a width respectively defining two longitudinal and two transverse ends; and ii) a pair of side panels of flexible sheet material, each hingedly joined to one of said transverse ends at first fold lines which extend a distance the entire length between said side panels and the central panel, each of said side panels having a second fold line parallel to said first fold line which extends the entire length of said side panel; and iii) a first wing panel of flexible sheet material hingedly joined to on of the longitudinal ends of the central panel at a third fold line which extends a distance the entire width at the interface of said first wing panel and the central panel, said first wing panel having a fourth fold line parallel to and spaced from said third fold line which extends the entire width of said first wing panel; and iv) a second wing panel of flexible sheet material hingedly joined to the opposite longitudinal end of the central panel at a fifth fold line which extends a distance the entire width at the interface of said second wing panel and the central panel; said second wing panel having sequentially a sixth fold line parallel to and spaced from said fifth fold line which extends the entire width of said second wing panel and a seventh fold line parallel to and spaced from said sixth fold line which extends the entire width of said second wing panel and then a pair of spaced, tearable perforation lines which extend the entire width of said second wing panel, which pair of spaced perforation lines form a removable pull tab element; and b) providing an insert member which comprises two generally rectangular panels of flexible sheet material defining a top insert panel and a bottom insert panel each having a length and a width, said top and bottom insert panels being joined at a central fold line extending their entire width; said top insert panel having a tearable perforation line spaced from said central fold line and extending the entire width of said top insert panel; and c) folding each of said side panels along said first fold line into a plane perpendicular to the plane of said central panel, and then folding each of said side panels at the second fold line into a plane parallel to and above the plane of said central panel; and d) folding said first wing panel along said third fold line into a plane perpendicular to the plane of said central panel, and then folding said first wing panel along said fourth fold line into a plane parallel to the plane of said central panel and being positioned over a portion of each of said side panels; and e) folding the insert member at its central fold line and positioning the insert member within said outer shell member such that the bottom insert panel is disposed between said central panel and said side panels and said top insert panel is disposed between said side panels and said first wing panel with said central fold line of the insert member being positioned at said opposite longitudinal end of the central panel; and f) folding the second wing panel along said fifth fold line into a plane perpendicular to the plane of said central panel and then folding said second wing panel along said sixth fold line into a plane parallel to the plane of said central panel and being positioned over said insert member; and g) adhering a band of pressure sensitive adhesive tape around both said central panel and an end of each of said first and second wing panels; and h) adhering a second band of pressure sensitive adhesive tape extending around said central panel and around said second wing panel between said first band of pressure sensitive adhesive tape and said pull tab element.

18. The method of claim 17 wherein each of the outer shell member and the insert member comprise a material selected from the group consisting of paperboard, fiberboard, paperboard coated with plastic, and corrugated cardboard.

19. The method of claim 17 wherein each of the outer shell member and an insert member are composed of corrugated cardboard having corrugation lines displaced 90 degrees from one another.

20. The method of claim 19 wherein the outer shell member has longitudinally extending corrugation lines along its length and the insert member has transversely extending corrugation lines extending across its width.

21. The method of claim 17 wherein each of the wing panels and side panels are notched at their corners.

22. The method of claim 17 wherein the wing panels are of approximately the same size and the side panels are of approximately the same size.

23. The method of claim 17 wherein the insert top panel is slightly larger than the central panel, and the insert bottom panel and the central panel are of approximately the same size.

* * * * *